US006175224B1

(12) United States Patent
Kadanka

(10) Patent No.: US 6,175,224 B1
(45) Date of Patent: Jan. 16, 2001

(54) REGULATOR CIRCUIT HAVING A BANDGAP GENERATOR COUPLED TO A VOLTAGE SENSOR, AND METHOD

(75) Inventor: Petr Kadanka, Roznov pod Radhostem (CS)

(73) Assignee: Motorola, Inc., Schaumburg, IL (US)

( * ) Notice: Under 35 U.S.C. 154(b), the term of this patent shall be extended for 0 days.

(21) Appl. No.: 09/106,934

(22) Filed: Jun. 29, 1998

(51) Int. Cl.[7] ..... G05F 1/40
(52) U.S. Cl. ..... 323/281; 323/280; 323/314
(58) Field of Search ..... 323/280, 281, 323/313, 314, 907

(56) References Cited

U.S. PATENT DOCUMENTS

| | | | | |
|---|---|---|---|---|
| 4,064,448 | * | 12/1977 | Eatock | 23/22 T |
| 4,636,710 | * | 1/1987 | Stanojevic | 323/280 |
| 4,902,959 | | 2/1990 | Brokaw | 323/314 |
| 5,394,078 | | 2/1995 | Brokaw | 323/313 |
| 5,406,222 | | 4/1995 | Brokaw | 330/257 |
| 5,625,278 | * | 4/1997 | Thiel et al. | 323/280 |
| 5,631,551 | * | 5/1997 | Scaccianoce et al. | 323/313 |
| 5,631,598 | | 5/1997 | Miranda et al. | 327/540 |
| 5,686,821 | | 11/1997 | Brokaw | 323/273 |

* cited by examiner

*Primary Examiner*—Peter S. Wong
*Assistant Examiner*—Gary L. Laxton
(74) *Attorney, Agent, or Firm*—Lanny L. Parker

(57) ABSTRACT

A regulator (200) has a pass transistor (250) for transferring a voltage from an input (202) to an output (205). A voltage sensor (231) at the output (205) carries a PTAT current ($I_A$) A generator with diode or transistor chains (271, 272) derives a voltage $V_{RES}$ from serially coupled base-emitter path of transistors (381–386) having different current densities. The generator (271, 272) and a transistor pair (273) form a bandgap reference circuit. Each chain (271, 272) has transistors alternatively of a first type (pnp) and second type (npn). The value ratio ($R_4/R_3$) of resistances (240, 230) in the voltage sensor (231) can be chosen such, that the noise components of the voltage $V_{OUT}$ at the output (205) is low.

2 Claims, 2 Drawing Sheets

200

REGULATOR CIRCUIT HAVING A BANDGAP GENERATOR COUPLED TO A VOLTAGE SENSOR, AND METHOD

FIELD OF THE INVENTION

The present invention generally relates to electronic circuits, and, more particularly, to a voltage regulator, and to a method therefor.

BACKGROUND OF THE INVENTION

In electronic circuits, voltage regulators provide substantially constant supply voltages for voltage sensitive portions of the circuit. Usually, regulators have a pass transistor to change a preferably low voltage drop between input and output, a voltage sensor at the output and a feedback unit which controls the pass transistor. The output voltage (e.g., constant 5 volts) should be independent of temperature, so that a temperature compensation circuit is sometimes required.

U.S. Pat. No. 5,686,821 to Brokaw [1] teaches a regulator with a two-resistor voltage sensor carrying a current proportional to the absolute temperature (PTAT). The resistors (R9 and R10 in FIG. 4 of [1]) have a value ratio related to a voltage provided by a bandgap reference. Positive and negative temperature coefficients of the current and the bandgap voltage compensate each other. A further useful reference is: Horowitz, P., Hill, W.: "The art of electronics", Second Edition, Cambridge University Press, chapter 6.15: "Bandgap ($V_{BE}$) reference", on pages 335–341 [2].

The output voltage should also have low noise components. Also, the feedback unit should not cause the regulator to oscillate. Regulators can have so-called bypass capacitors which function as noise filters and pole suppression filters. But, the bypass capacitor increases the turn-on time of the regulator. Capacitors are also not wanted because of their physical size.

The present invention seeks to provide regulators which mitigate or avoid these and other disadvantages and limitations of the prior art.

DETAILED DESCRIPTION OF THE PREFERRED EMBODIMENT

A regulator according to the present invention achieves features, such as, for example, substantial temperature independence, low noise, and stability in a low cost design. Sensor resistors in the regulator of the present invention can have value ratios which are substantially different than the value ratios in prior art bandgap references. The bandgap reference generator has multiple serially coupled base-emitter paths. This approach has the advantage that the noise density of the output voltage is low without the need for an external bypass capacitor.

Figure 1:
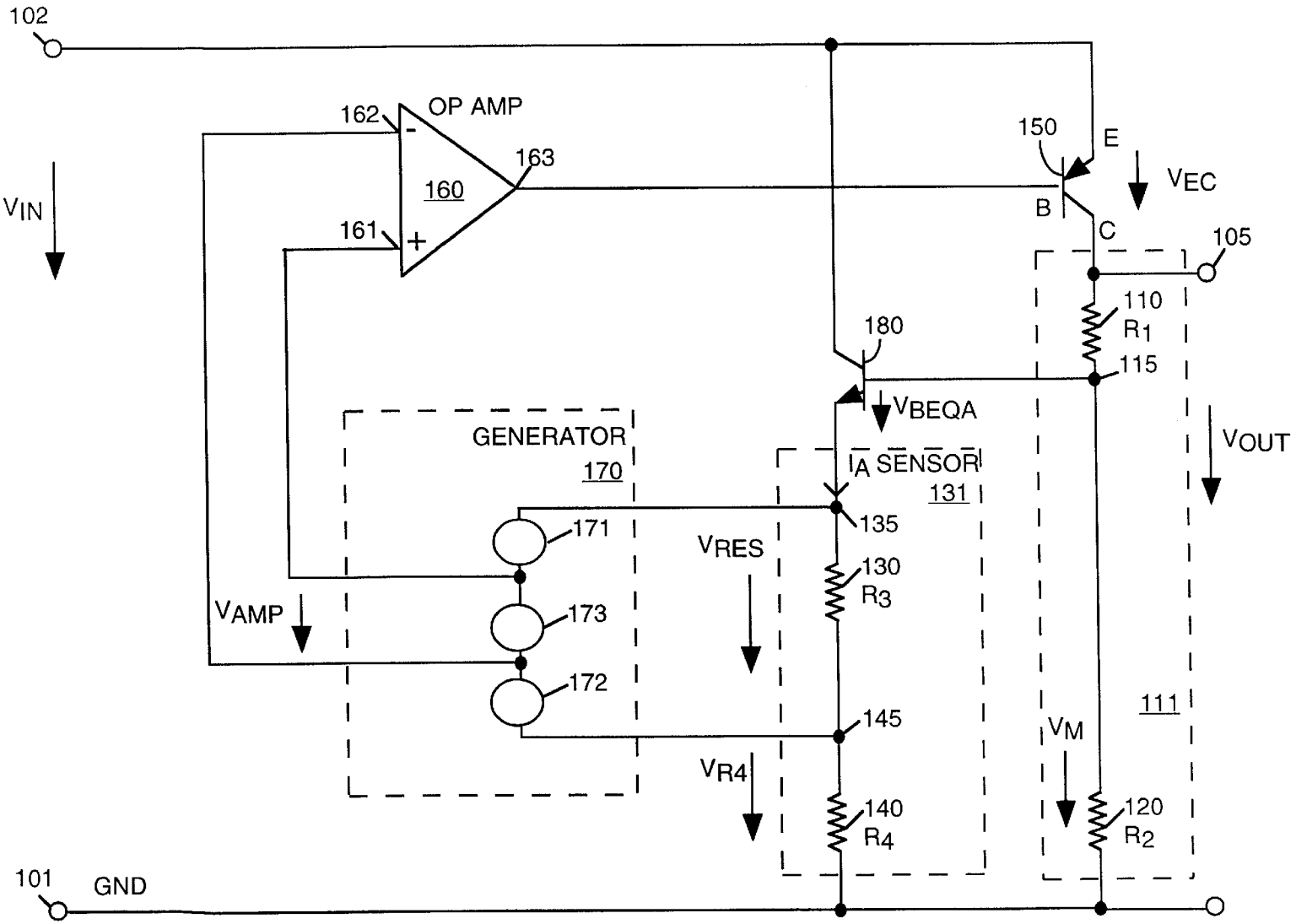
FIG. 1 illustrates a simplified schematic diagram of a regulator circuit according to the present invention.

FIG. 1 illustrates a simplified schematic diagram of regulator circuit 100 (hereinafter regulator 100) according to the present invention. Regulator 100 receives an unregulated input voltage $V_{IN}$ (between terminals 102 and 101) and provides a regulated output voltage $V_{OUT}$ (between terminals 105 and 101) to, for example, a voltage sensitive circuit portion (not shown). Regulator 100 comprises transistors 150 and 180, operational amplifier 160 ("controller"), resistor 110 having a value $R_1$ ("magnitude"), resistor 120 having a value $R_2$, resistor 130 having a value $R_3$, resistor 140 having a value $R_4$, and multiple junction voltage generator 170 (hereinafter generator 170, dashed frame). As those of skill in the art understand, for resistors (or "impedances") 110, 120, 130, and 140 any electrical components can be used that exhibits a resistance to the flow of current. Such impedances can be passive or active devices.

Transistor 150 is the pass transistor in the function of a variable resistance. An emitter (letter "E") of transistor 150 is coupled to input terminal 102 and a collector (letter "C") is coupled to output terminal 105. A base (letter "B") of transistor 150 is coupled to output 163 of operational amplifier 160. The collector of transistor 150 is also coupled to reference terminal 101 via resistor 110, node 115 and resistor 120. Transistor 180 has a collector coupled to input terminal 102 and an emitter coupled to reference terminal 101 via node 135, resistor 130, node 145, and resistor 140. Resistors 130 and 140 form voltage sensor 131, and resistors 110 and 120 form voltage sensor 111 (dashed frames). The base of transistor 180 is coupled to node 115.

Preferably, generator 170 has voltage sources 171, 173 and 172 serially coupled across resistor 130 (nodes 135 and 145). Voltage source 173 is in parallel coupled to inputs 162 and 161 of operational amplifier 160. The arrangement of voltage sources 171–173 in generator 170 is illustrated as an example to indicate that a fraction $V_{AMP}$ of a voltage $V_{RES}$ across resistor 130 goes into operational amplifier 160. Voltage sources 171 and 172 are, preferably, implemented by pn-junction chains (e.g., see FIG. 2). Preferably, inputs 162 and 161 of operational amplifier 160 are inverting ("−") and non-inverting ("+") inputs, respectively. This is convenient, but not essential for the present invention.

The term 'transistor' is intended to include any device having current electrodes (e.g., C and E) and control electrodes (e.g., B), such as for example, bipolar devices. Other types of transistors can also be used. Instead of transistor 180, any other pn-junction can also be used. The term "pn-junction" is intended to include junctions from a p-doped semiconductor to an n-doped semiconductor (e.g., base to emitter of an npn transistor) or vice versa from n-doped to p-doped semiconductors (e.g., base to emitter of a pnp transistor).

Regulator 100 is intended to be a non-limiting example for illustration. A person of skill in the art is able based on the following description to make changes without departing from the scope of the present invention.

In FIG. 1, voltages and currents are illustrated by arrows. The direction of the arrows is chosen only for convenience of explanation. Unless otherwise noted, voltages are referred to reference terminal 101 (labeled "GND" for "ground"). For example, the voltage $V_{OUT}$ refers to the voltage difference between output terminal 105 and reference terminal 101. A person of skill in the art is able to otherwise define currents and voltages. To have the following description applicable for different types of semiconductor devices (e.g., diodes, pnp-, npn-transistors), voltages are conveniently given in | | symbols for absolute values.

Regulator 100 receives input voltage $V_{IN}$ at input terminal 102 and provides output voltage $V_{OUT}$ at output terminal 105 depending on the emitter-collector voltage $V_{EC}$ ("dropout voltage") of transistor 150, that is:

$$|V_{OUT}|=|V_{IN}|-|V_{EC}| \quad (1)$$

Persons of skill in the art know how to select transistors to keep $|V_{EC}|$ as small as possible. The pn-junction voltage across the base and emitter of transistor 180 is referred to as $V_{BEQA}$.

Voltage sensor 111 derives a measurement voltage $V_M$ (across resistor 120) from output voltage $V_{OUT}$. Part of $V_M$ is fed back to operational amplifier 160 which controls transistor 150. Using well known voltage divider relations and considering voltage $V_{RES}$ across resistor 130, output voltage $V_{OUT}$ can be estimated by the following equation:

$$|V_{OUT}| = \left[|V_{RES}| * \left(1 + \frac{R_4}{R_3}\right) + |V_{BEQA}|\right] * \left(1 + \frac{R_1}{R_2}\right) \quad (2)$$

Current $I_A = V_{RES}/R_3$ flowing from the emitter of transistor 180 to reference terminal 101 is preferably, proportional to the absolute temperature (PTAT). Therefore, the voltage ($V_{RES}+V_{R4}$) across resistors 130 and 140 (carrying $I_A$) has, preferably, a positive temperature coefficient which compensates a negative temperature coefficient of $V_{BEQA}$.

To appreciate the advantages of the present invention, equation (2) is analyzed regarding parasitic noise voltages at $|V_{OUT}|$. At node 115, the noise components of $|V_{RES}|$ appear multiplied by the ratio $R_4/R_3$. On the way to output terminal 105, the noise components of $|V_{RES}|$ are further multiplied by $R_1/R_2$. A low ratio $R_4/R_3$ would provide low noise, or, vice versa, a high ratio $R_4/R_3$ would cause high noise. To have a low $R_4/R_3$ ratio, the voltage $|V_{RES}|$ should be high. According to the present invention, this is achieved with multiple serially coupled pn-junctions in generator 170.

Figure 2:
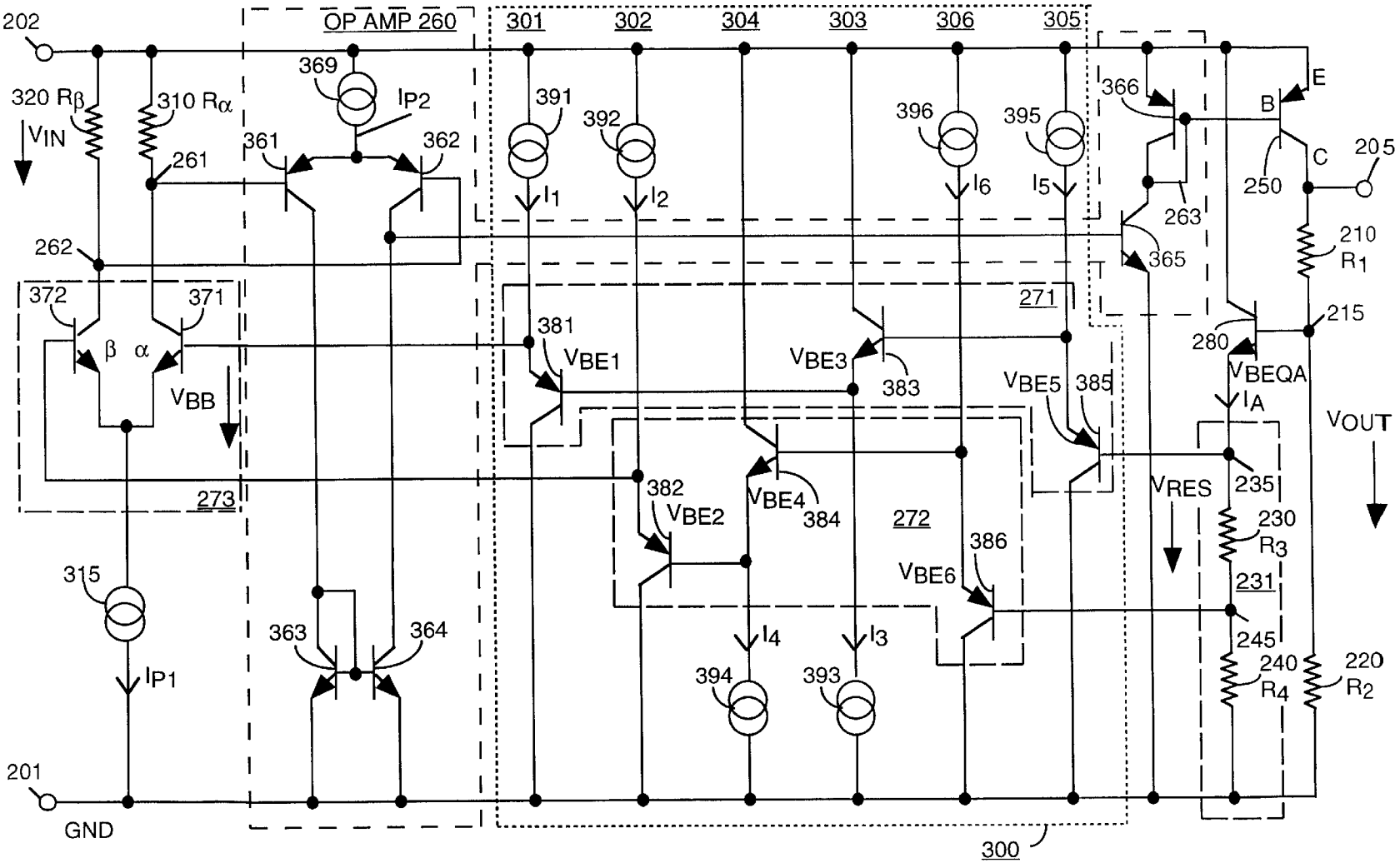
FIG. 2 illustrates a simplified schematic diagram of the regulator circuit of FIG. 1 showing further detail.

FIG. 2 illustrates a simplified schematic diagram of circuit 200 which is a preferred embodiment of regulator 100. In FIGS. 1–2, reference numbers 101/201, 102/202, 105/205, 110/210, 115/215, 120/220, 130/230, 131/231, 135/235, 140/240, 145/245, 150/250, 160/260, 161/261, 162/262, 163/263, 171/271, 172/272, 173/273, 180/280 and symbols $V_{IN}$, $V_{RES}$, $V_{EC}$, $V_{BEQA}$, and $I_A$ stand for analogous components or signals. However, their function can differ as explained below. Among them, operational amplifier 260, voltage sensor 231, and chains 271, 272, 273 (cf. voltage sources in FIG. 1) are illustrated by dashed frames. Circuit 200 further comprises transistors 361, 362, 363, 364, 365 and 366 forming operational amplifier 260, transistors 371 and 372 forming pair 273 (or "chain 273"), transistors 381, 383 and 385 forming chain 271, transistors 382, 384 and 386 forming chain 272, current sources 315, 369, 391, 392, 393, 394, 395 and 396, and resistors 310, 320. In chains 271 and 272, transistors 385/383/381 and 386/384/382, respectively, are serially coupled via their base-emitter paths. Preferably, these chain transistors are alternatively of opposite types, as, for example, first type (385), second type (383) and again first type (381) in chain 371. The terms "first type" (e.g., for npn- or pnp-transistors) and "second type" (e.g., for pnp- or npn-transistors) are intended to distinguish complementary transistors of opposite conductivity. "First type" and "second type" can refer to either npn or pnp transistors, as the case may be.

In the preferred embodiment of circuit 200, transistors 385, 381, 386 and 382 are pnp-transistors ("first type"); and transistors 383 and 384 are npn-transistors ("second type"). The types of transistors which do not form a chain, are not important for the present invention. For example, transistors 250, 361, 362 and 366 are preferably pnp-transistors; and transistors 280, 363, 364, 371, 372, 365 are preferably npn-transistors. Current sources 315, 369, and 391 to 396 provide currents $I_{P1}$, $I_{P2}$, and $I_1$ to $I_6$, respectively. For convenience of explanation, these currents and current $I_A$ are directed to reference terminal 201. Persons of skill in the art can implement the current sources, for example, by transistors. Transistor 371 is conveniently referred to by index "α"; and transistor 372 is referred to by index "β". The voltage between the bases of transistors 371 and 372 is referred to as chain voltage $V_{BB}$. Resistors 210, 220, 230, 240 have values $R_1$, $R_2$, $R_3$, and $R_4$, respectively (as in FIG. 1); resistor 310 has value $R_\alpha$, and resistor 320 has value $R_\beta$.

In the following explanation, the transistor electrodes are conveniently cited by the letters "C" for "collector", "E" for "emitters" or "B" for "base" in connection with the transistors number. FIG. 2 illustrates the letters at transistor 250. For example, "E-250" stands for "emitter of transistor 250". Plural terms are given as "Cs", "Es", and "Bs". The transistors are illustrated as discrete components. This convention is convenient for explanation and intended to include that (a) a single transistor can have multiple electrodes with similar function (i.e., multiple E, multiple C, and multiple B) and that (b) two or more transistors can share electrodes (e.g., common E of two transistors).

Input terminal 202 is coupled to E-250. C-250 is coupled to output terminal 205. B-250 is coupled to C-366 and B-366 which form output node 263 of operational amplifier 260. Output terminal 205 is coupled to reference terminal 201 via resistors 210, node 215 and resistor 220. Node 215 is coupled to B-280. C-280 is coupled to input terminal 202. E-280 is coupled to reference terminal 201 via node 235, resistor 230, node 245 and resistor 240. In operational amplifier 260, B-361 is coupled to C-372 of chain 273 and forms input 261; and B-362 is coupled to C-371 of chain 273 and forms input 262. Current source 369 is coupled between input terminal 202 and a node of E-361 and E-362. Transistors 361 and 362 form a differential pair. The pair is further coupled to reference terminal 201 via a current mirror. The mirror is formed by transistors 363 and 364 coupled as follows: C-361 to C-363 and to B-363/B-364;

C-362 to C-364, and E-363, E-364 to terminal 201. B-365 is coupled to C-362. E-365 is coupled to terminal 201. C-365 is coupled to C-366, B-366 and B-250 (output 263). E-366 is coupled to terminal 202. Transistors 366 and 250 also form a current mirror. Resistor 310 is coupled between input terminal 202 and C-371; and resistor 320 is coupled to C-372. E-371 and E-372 are coupled together to terminal 201 via current source 315. The opposite coupled base-emitter path of transistors 371 and 372 form chain 273 having the chain voltage $V_{BB}$. Chain 273 is coupled to chains 271 and 273 through B-371 coupled to E-381 and B-372 coupled to E-382, respectively. Chain 371 is coupled to resistor 230 by B-385 at node 235; and chain 372 is coupled to resistor 230 by B-386 at node 245. Further, in chain 371, E-385 is coupled to B-383; and E-383 is coupled to B-381. In chain 372, E-386 is coupled to B-384; and E-384 is coupled to B-382.

There are multiple current paths k=1 to K between terminals 202 and 201. In the example of FIG. 2, K=6. In FIG. 2, the paths (reference numbers 301–306, or "**30*k*") are surrounded by dashed frame 300. In each path, a current source and an emitter-collector path of a transistor are coupled between input terminal 202 and reference terminal 201**.

In path 1, current source 391 is coupled between terminal 202 and E-381; and C-381 is coupled to terminal 201. In path 2, current source 392 is coupled between terminal 202 and E-382; and C-382 is coupled to terminal 201. In path 3, C-383 is coupled to terminal 202; and E-383 is coupled to terminal 201 via current source 393. In path 4, C-384 is coupled to terminal 202; and E-384 is coupled to terminal 201 via current source 394. In path 5, current source 395 is coupled between terminal 202 and E-385; and C-385 is coupled to terminal 201. In path 6, current source 396 is coupled between terminal 202 and E-386; and C-386 is coupled to terminal 201.

As explained above, the $N_1$=3 transistors 381, 383 and 385 (chain 371) of odd numbered paths 1, 3 and 5 are serially coupled with pn-junctions (base and emitter). The $N_2$=3 transistors 382, 384, 386 (chain 372) of even numbered paths 2, 4 and 6 are also serially coupled with pn-junctions. The numbers $N_1$ and $N_2$, are, preferably equal ($N_1$=$N_2$=N) so that the total number of chain transistors K=$N_1$+$N_2$ is even. The example of circuit 200 in FIG. 2 is illustrated the present invention with N =3 transistors in each of chains 371 and 372. This is convenient, but not essential for the present invention.

Transistors 381 to 386 have emitter areas $A_1$ to $A_6$, respectively ($A_k$ for transistor 38*k*). Currents $I_1$ to $I_6$ flow through transistors 381 to 386, respectively ($I_k$ for 38*k*). Conveniently, currents $I_k$ and areas $A_k$ are chosen such, that current densities $I_k/A_k$ of neighboring paths k and (k+1) differ. Current density ratios $Y_{qp}$ between any pairs of transistors "q" and "p" among transistors 381–386 and 371/372 can be defined as:

$$Y_{qp} = \frac{I_q / A_q}{I_p / A_p} \tag{3}$$

For example, $Y_{12}$ is the density ratio between transistors 391 and 392; and $Y_{\alpha\beta}$ the ratio between transistors 371 and 372. Therefore, base-emitter voltages $V_{BE1}$ to $V_{BE6}$ of transistors 381 to 386, respectively, are also different. The voltage $V_{RES}$ across resistor 230 calculated using the mesh law for chains 371, 373 and 372 as follows:

$$V_{RES}+V_{BE5}+V_{BE3}+V_{BE1}-V_{BB}-V_{BE2}-V_{BE4}-V_{BE6} \tag{4}$$

$$V_{RES} = +V_{BE5} + V_{BE3} + V_{BE1} - V_{BB} - V_{BE2} - V_{BE4} - V_{BE6} \tag{4}$$

$$V_{RES} = -V_{BB} + \sum_{k=1}^{K} \pm V_{BEk} \quad (+\text{for odd } k, \ - \text{ for even } k) \tag{5}$$

The base-emitter voltages $V_{BE}$ of transistors of first and second types have different signs. For example, $V_{BEk}$ of pnp-transistors 381, 382, 385, 386 are negative ($V_{BEk}$<0); and $V_{BEk}$ of npn-transistors 383 and 384 are positive ($V_{BEk}$>0). $V_{BE\alpha}$ of npn-transistor 371 and $V_{BE\beta}$ of npn-transistor 372 are also positive. Therefore, $V_{BE}$-voltages within chains 371 and 372 partly compensate each other. This is an important aspect of the present invention. Writing $$V_{BB}=V_{BE\alpha}-V_{BE\beta} \tag{6}$$

equation (5) can be expressed as: (7)

$$V_{RES}=-V_{BE\alpha}+V_{BE\beta}+V_{BE1}-V_{BE2}+V_{BE3}-V_{BE4}+V_{BE5}-V_{BE6}V_{RES}=-V_{BE\alpha}|+|V_{BE\beta}|-|V_{BE1}|+|V_{BE2}+|V_{BE3}|-|V_{BE4}|-"V_{BE5}|+|V_{BE6}| \tag{8}$$

$V_{RES}$ depends also on the current density ratios $Y_{qp}$ and on the temperature voltage $V_T$ as follows:

$$V_{RES} = V_T * \ln(Y) = V_T * \ln\left(\prod_{m=0}^{M} Y_{qp}^{(m)}\right), \tag{9}$$

wherein "In" stands for logarithm naturalis operation and symbols "*" and "Π" stand for multiplication. For convenience, superscript index (m) also identifies transistor pairs. M is the number of transistor pairs which have density ratios $Y_{qp}$. Preferably, M is an even number. M is conveniently half the number of transistors in chains 371 and 372 (e.g., K=6) plus 2 for transistors 371/372, that is $$M=K/2+2 \tag{10}$$

$$M=6/2+2=4 \tag{11}$$

as shown for example in circuit 200. Temperature voltage $V_T$ is known in the art and described e.g., in [2] as $$V_T=k*T/e_0, \tag{12}$$

with k=1.38*$10^{-23}$ Joule/Kelvin, $e_0$=1.60*$10^{-19}$ Coulomb, and T the absolute temperature in Kelvin. For T=300 K, VT is around 26 mV (millivolts).

As mentioned above, the current densities are conveniently chosen such that ($V_{RES}$+$V_{R4}$) has a positive temperature coefficient to compensate the negative temperature coefficient of $V_{BEQA}$.

Current density ratios $Y_{qp}$ can have any positive values of integers (e.g., 1, 2, 3 . . . ) or real numbers (e.g., 0.25, 4.25). A convenient value range for current density ratios $Y_{qp}$ is $1 \leqq Y_{qp} < 100$. Preferred values of $Y_{qp}$ are in the range $6 \leqq Y_{qp} < 20$. For example, and not intended to be limiting, current density ratios $Y_{qp}^{(m)}$ are $Y_{\alpha\beta}^{(1)}$=16 (transistors 371 and 372), $Y_{12}^{(2)}$=9 (transistors 391 and 392), $Y_{34}^{(3)}$=16 (transistors 393 and 394), $Y_{56}^{(4)}$=12 (transistors 395 and 396). According to equation (9), $V_{RES}$ is estimated as, approximately, $$V_{RES}=26 \text{ mV}*\ln(16*9*16*12)\approx 270 \text{ mV} \tag{13}$$

Preferably, the voltage ($V_{RES}$+$V_{R4}$) across resistors 230 and 240 has similar absolute values as a transistor base-emitter voltage (e.g., 270 mV+330 mV=600 mV, $R_4/R_3 \approx 1.2$ less than in prior art).

Having described a preferred embodiment, the present invention is considered as regulator circuit 100 which comprises: (a) transistor 150 which receives input voltage $V_{IN}$ (at E-150) and providing output voltage $V_{OUT}$ (at C-150); (b) voltage sensor 111 with resistor 110 and resistor 120 serially coupled for deriving a measurement voltage $V_M$ (e.g., voltage across resistor 120) from output voltage $V_{OUT}$; (c) a controller (e.g., operational amplifier 160) which receives measurement voltage $V_M$ (e.g., via transistor 180) and which controls transistor 150; and (d) a multiple $V_{BE}$ voltage generator (e.g., by generator 170, sensor 130, and transistor 180) which is coupled to resistor 110. In the multiple $V_{BE}$ bandgap reference, voltage $V_{RES}$ having a first temperature coefficient (e.g., positive coefficient) is provided by pn-junction chains (e.g., chains 271, 272) in which the pn-junctions (e.g., transistors 381–386) have different current densities.

Further, the present invention can be described as a circuit with the following properties: Transistor 150 receives unregulated input voltage $V_{IN}$ at a first main terminal (e.g., at the emitter) and provides regulated output voltage $V_{OUT}$ to a second main terminal (e.g., collector). Controller 160 controls transistor 150 via a transistor control terminal (e.g., a base). Resistor 110 and resistor 120 are serially coupled between the second main terminal of transistor 150 and reference terminal 101 via node 115. A pn-junction (e.g., between base and emitter of transistor 180) provides a voltage (e.g., $V_{BEQA}$) with a first temperature coefficient (e.g., negative). A first junction terminal (e.g., a base) is coupled to node 115. Resistor 130 and resistor 140 are serially coupled between a second junction terminal (e.g., emitter) of the pn-junction and reference terminal 101. Resistors 130 and 140 are coupled to controller 160. A multiple junction voltage generator (chains 171–173) is coupled across resistor 130 and provides a second, compensating temperature coefficient (e.g., positive).

Still further, the present invention can be described, e.g., in connection with circuit 100, which regulates output voltage $V_{OUT}$ by controlling a variable resistance (e.g., transistor 150) through a measurement signal (e.g., $V_M$). The measurement signal is derived from output voltage $V_{OUT}$ by voltage sensor 130. Circuit 100 is characterized by: (a) A plurality of K current paths (e.g., 30*k*) each having a current source (e.g., 39*k*) and a pn-junction (e.g., transistors 38*k*). The pn-junctions have areas $A_k$ and different current densities $J_k=I_k/A_k$ so that some or all voltages $V_{BEk}$ across the pn-junctions are different. The pn-junctions k are serially coupled in pairs (e.g., transistors 381/382, 383/384, 385/386). (b) A first number of pn-junctions is arranged in a first direction (e.g., base-emitter of pnp-transistors) and a second number of pn-junctions is arranged in a second, opposite direction (e.g., base-emitter of npn-transistors) so that only the differences of $V_{BEk}$, but not their absolute values $|V_{BEk}|$ are combined (e.g., added) to voltage $V_{RES}$ present in voltage sensor 130 (e.g., across resistor 130).

Having explained the function of regulator circuit 100 in detail above, a method of the present invention is described as a method for regulating output voltage $V_{OUT}$. The method has the following steps: (a) receiving input voltage $V_{IN}$ by pass transistor 150 and providing output voltage $V_{OUT}$ as difference (e.g., $|V_{EC}|$, see equation (1)) to input voltage $V_{IN}$; (b) providing a PTAT current to a voltage divider (e.g., sensor 131 with resistors 130 and 140); (c) providing voltage $V_{RES}$ from a plurality of serially coupled pn-junctions (e.g., transistors 381–386) to one part (e.g., resistor 130) of the voltage divider; and (d) measuring output voltage $V_{OUT}$ by the voltage divider and changing the difference accordingly.

Preferably, in providing step (c), voltage $V_{RES}$ is derived from pn-junctions of transistors with alternatively opposite type (e.g., pnp-transistors and npn-transistors), wherein in pairs of pn-junctions (e.g., of transistors 381–386), the current densities are different.

It is an important advantage of the present invention, that a regulator without an external bypass capacitor can be implemented together with the voltage sensitive circuit portion on a single semiconductor substrate.

It will be appreciated that although only one particular embodiment of the invention has been described in detail, various modifications and improvements can be made by a person skilled in the art based on the teachings herein without departing from the scope of the present invention. Accordingly, it is the intention to include such modifications as will occur to those of skill in the art in the claims that follow.

What is claimed is:

1. A circuit regulating an output voltage by controlling a variable resistance through a measurement signal derived from the output voltage by a voltage sensor, characterized in that:

a plurality of current paths identified by an index k, wherein said index is an integer, said current paths each having a current source identified by said index k and an emitter-collector path of a transistor identified by said index k serially coupled between a first reference terminal and a second reference terminal, said transistors having emitter areas $A_k$ and different current densities $J_k=I_k/A_k$ SO that some or all voltages $V_{BEk}$ across the base-emitter paths of said transistors k in each current path k are different, and wherein said transistors form pairs; and a first number of said emitter-collector paths being arranged in respect to said first and second reference terminals in a first direction; and a second number of said emitter-collector paths being arranged in respect to said first and second reference terminals in a second, opposite direction; and wherein only the voltage differences $V_{BEk}$ are combined by coupling base electrodes to emitter electrodes of neighboring pairs so that only the differences of $V_{BEk}$, but not their absolute values are combined with a voltage present in said voltage sensor.

2. The circuit of claim 1 wherein said first number of said emitter-collector paths belong to npn-transistors; and said second number of said emitter-collector paths belong to pnp-transistors.

* * * * *